US005954539A

United States Patent [19]

Hornung

[11] Patent Number: 5,954,539

[45] Date of Patent: Sep. 21, 1999

[54] METHOD OF HANDLING PARTS AND STRUCTURE THEREFOR

[75] Inventor: Craig W. Hornung, Harrisburg, Pa.

[73] Assignee: The Whitaker Corporation, Wilmington, Del.

[21] Appl. No.: 08/763,495

[22] Filed: Dec. 11, 1996

Related U.S. Application Data

[63] Continuation of application No. 08/373,725, Jan. 17, 1995, abandoned.

[51] Int. Cl.[6] ..... H01R 13/40

[52] U.S. Cl. ..... 439/590; 174/67; 439/937

[58] Field of Search ..... 439/590, 937; 174/67

[56] References Cited

U.S. PATENT DOCUMENTS

| | | | |
|---|---|---|---|
| 3,152,390 | 10/1964 | Floyd, Jr. | 29/203 |
| 3,846,900 | 11/1974 | Weglage | 29/413 |
| 4,133,102 | 1/1979 | Gillemot | 29/50 |
| 4,183,239 | 1/1980 | Stubbings | 72/391 |
| 4,360,969 | 11/1982 | Collier | 439/937 |
| 4,388,753 | 6/1983 | Brookes | 29/433 |
| 4,449,283 | 5/1984 | Berecz et al. | 29/566.1 |
| 4,466,692 | 8/1984 | Sonoda | 439/937 |
| 4,489,589 | 12/1984 | Kirsinas et al. | 72/424 |
| 4,535,925 | 8/1985 | Ramey et al. | 227/55 |
| 4,648,178 | 3/1987 | McGrath | 29/811 |
| 4,733,460 | 3/1988 | Auger et al. | 29/811 |
| 5,236,341 | 8/1993 | Stafford | 221/200 |

FOREIGN PATENT DOCUMENTS

| | | | |
|---|---|---|---|
| 2041254 | 9/1980 | United Kingdom | 439/937 |

*Primary Examiner*—Neil Abrams
*Assistant Examiner*—Eugene G. Byrd
*Attorney, Agent, or Firm*—Bradley N. Ditty

[57] ABSTRACT

A method and structure is disclosed for providing a plurality of parts (34, 80, 110) to a tool (22) in a work station (20) for use in a manufacturing operation. The parts, such as electrical components, wire connectors or connector parts are arranged in a chain (40, 100) or block (112) wherein each part is separably connected to another part in the chain or block without the use of a carrier tape (10) or integral sections (14) that must be broken or removed and discarded. The parts are interconnected by means of first and second features (54, 66) that are formed integral to the parts. The first feature (54) is a projection and the second feature (66) is an opening that conformably receives the projection and, when mated, holds the two parts together. The chain may be stored on a reel and later dereeled to be fed into a tool for performing a manufacturing operation. A single part can easily be removed from the chain or block.

12 Claims, 5 Drawing Sheets

METHOD OF HANDLING PARTS AND STRUCTURE THEREFOR

This application is a Continuation of application Ser. No. 08/373,725 filed Jan. 17, 1995 now abandoned.

The present invention relates to providing a plurality of parts to a tool in a work station for use in a manufacturing operation. The parts, such as electrical components, wire connectors or connector parts are arranged in a chain where each part is separably connected to another part in the chain without the use of a carrier tape or integral sections that must be broken or removed and discarded.

BACKGROUND OF THE INVENTION

Certain manufacturing operations require the use of many similar parts that are used one at a time in relatively quick succession. For example, a quantity of rivets can be loaded into a riveting tool and then inserted into a series of rivet holes and expanded to hold two parts together. Such a riveting tool is disclosed in U.S. Pat. No. 4,535,925 which issued Aug. 20, 1985 to Ramey et al. The individual rivets, disclosed therein, are interconnected at their flanges with a fragile link, thereby forming a strip of rivets that can be handled as a unit. A strip of rivets is loaded into the tool so that a spring loaded plunger urges the strip toward the breach thereby positioning the first rivet for use. When the tool is operated, the fragile link between the first and second rivets is forcefully broken and the first rivet driven by a ram into the opening and expanded in the usual manner. The next rivet is automatically advanced into the breach and the process repeated as desired. The forceful breaking of the fragile link can sometimes damage the rivet flanges and may leave rough edges.

Another example of the use of a fragile link is disclosed in U.S. Pat. No. 4,648,178 which issued Mar. 10, 1987 to McGrath. There, a stapler device utilizes a strip of interconnected plastic staples, or clips, which are interconnected by fragile links. The clips are used to clamp a tubular member such as the neck of a balloon to seal it closed. As the stapler is operated a clip is forcefully broken away from the strip, then crimped onto the neck of a balloon. As in the use of the riveting tool, the forceful breaking of the fragile link can sometimes damage the clips and may leave rough edges.

Carrier strips are sometimes used to avoid the problems associated with fragile link structures. A carrier strip can be in the form of a tape 10 having parts 12, wire connectors in the present example, separably attached thereto, as shown in FIG. 1, or links 14 integrally formed to the parts 12, as shown in FIGS. 2 and 3. In the case of the tape, the wire connectors 12 are separably held to the tape 10 by means of adhesive or by a relatively thin membrane of plastic, or other material, that is fastened to the tape and looped over the wire connector thereby forming a socket that holds the wire connector on the tape. The tape 10 includes feed openings 16 that are usually engaged by a sprocket or feed dog to advance the tape in the tool. When the tool is operated, the wire connector is crimped onto the leads of a component and then pulled off of the tape without damage to the wire connector. As wire connectors are crimped and separated from the carrier tape 10, the tape is shunted to a discard chute for later disposal. In the case of the links 14, the tool includes a shearing mechanism that shears through the link adjacent each wire connector 12 immediately prior to crimping the wire connector onto the leads of the component. This operation does not damage the wire connector; however, substantial power is required to perform the shearing operation as well as a portion of the power stroke. With both of these structures, there is a residue that must be disposed of, in the form of the tape 10 or the link segments 14. This can be a serious problem when environmentally incompatible materials are used. Further examples of the use of a carrier tape to present parts to a tool are disclosed in U.S. Pat. Nos. 4,133,102 that issued Jan. 9, 1979 to Gillemot and 4,733,460 that issued Mar. 29, 1988 to Auger et al.

What is needed is a method and structure for presenting a plurality of parts to a tool for use in a manufacturing operation where the parts are separably attached to each other to form a chain, and wherein the attachment is a frictional attachment only and there is no residue that needs to be discarded.

SUMMARY OF THE INVENTION

A method is disclosed for providing a plurality of similar parts in seriatim to a work station and using the parts by a tool in performing a manufacturing operation. The method includes the following steps.

Providing a plurality of similar parts.

Providing first and second spaced apart mating features on each of the similar part so that when a first feature of one is mated with a second feature of another, the two are separably held together.

Forming a chain of at least two parts separably held together by mating the first features of some of the parts to the second features of respective others of the parts.

Providing a tool in a work station for receiving a the chain presented thereto, the tool capable of separating a part from the chain and using the separated part in the manufacturing operation.

Presenting the chain to the tool.

Operating the tool to perform the manufacturing operation.

DESCRIPTION OF THE PREFERRED EMBODIMENT

Figure 1:
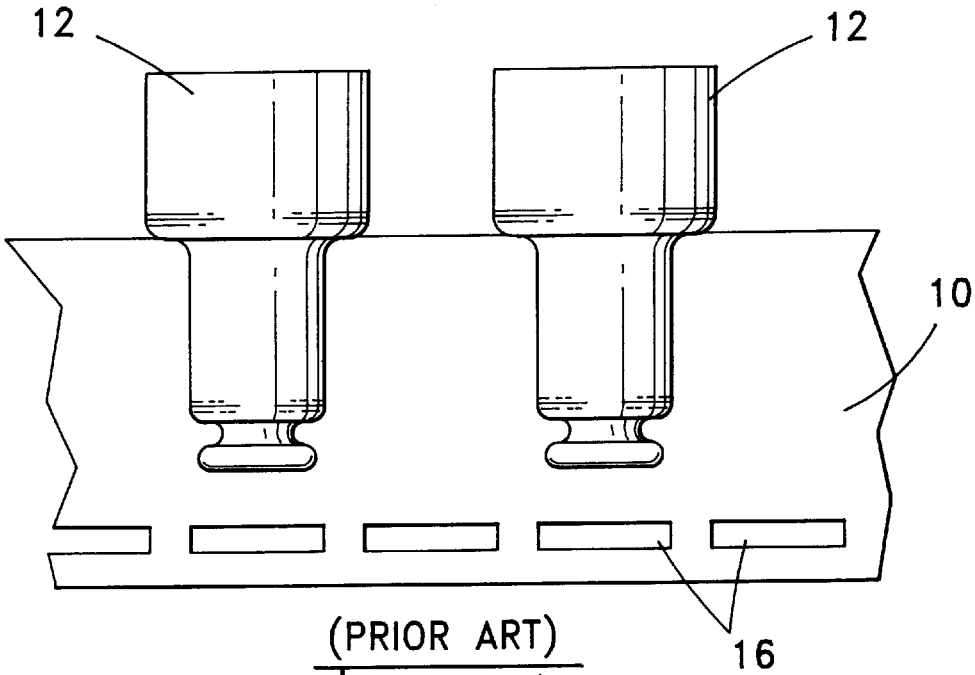
(PRIOR ART) Fig. 1
FIG. 1 is a view illustrating parts arranged on a carrier tape as known in the prior art.
Figure 2:
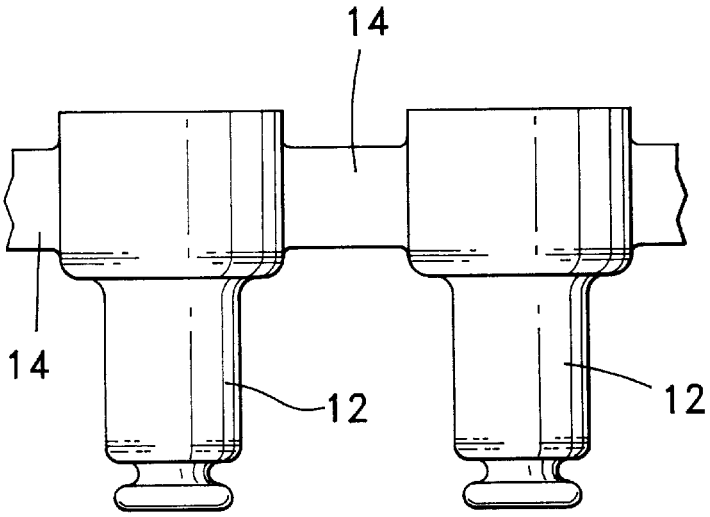
(PRIOR ART) Fig. 2
FIGS. 2 and 3 are plan and side views of a strip of parts interconnected by a web, as known in the prior art.
Figure 3:
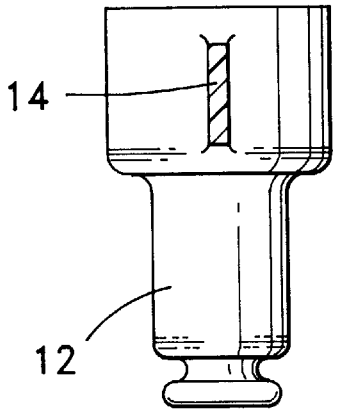
(PRIOR ART) Fig. 3
Figure 4:
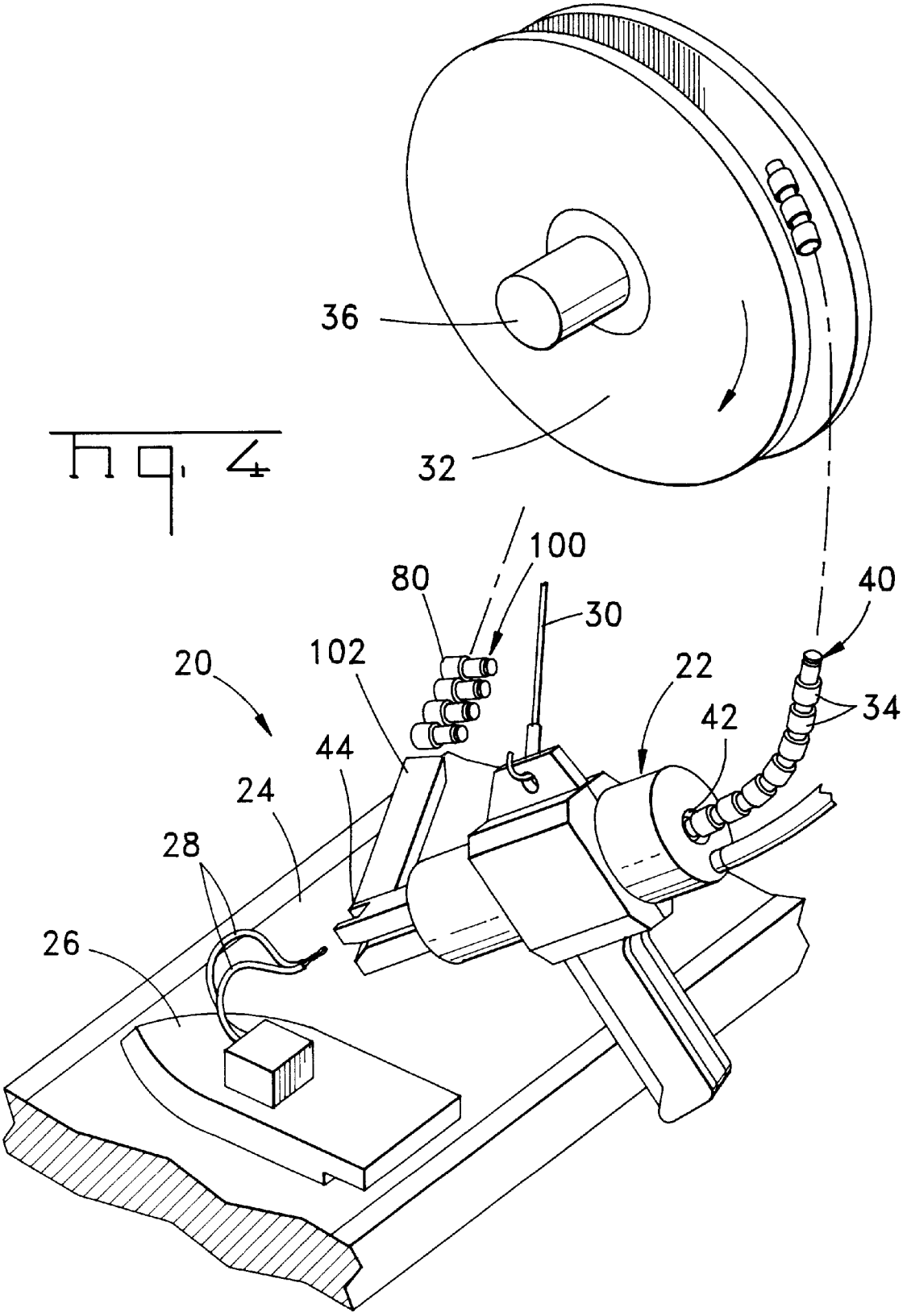
FIG. 4 is an isometric view showing a tool in a work station utilizing a chain of wire connectors incorporating the teachings of the present invention.

There is shown in FIG. 4 a typical work station 20 and a hand operated tool 22 for performing a manufacturing operation. A moving conveyer 24 moves components 26 into the work station, each component having a pair of leads 28 that are to be interconnected with a wire connector. One end of a cable 30 is attached to the tool 22 while the other end is attached to a counterbalance mechanism, not shown, that is arranged above the tool for assisting the operator in the usual manner. A reel 32 of wire connectors 34 is rotationally mounted to a spindle 36 directly above the work station 20. The wire connectors 34 are separably attached to each other to form a chain 40 of wire connectors, as shown in FIG. 4. The tool 22 includes an opening 42 in one end which leads to the crimping dies 44 at the other end. The chain 40 of wire connectors 34 is presented to the tool by inserting an end of the chain into the opening 42 and cycling the tool so that the first wire connector is advanced into crimping position within the crimping dies 44.

Figure 5:
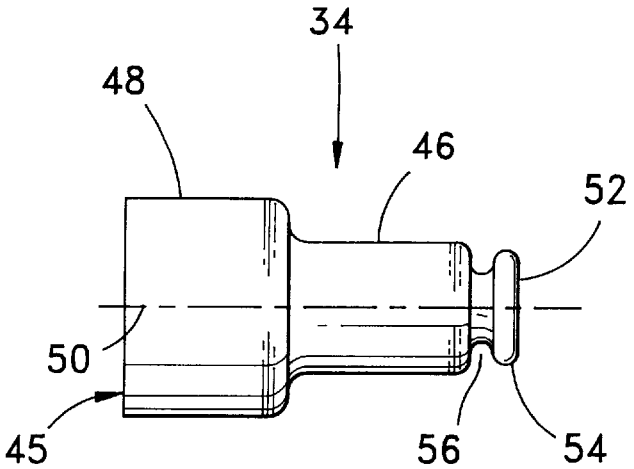
FIGS. 5 and 6 are side and end views of a wire connector incorporating the teachings of the present invention.
Figure 6:
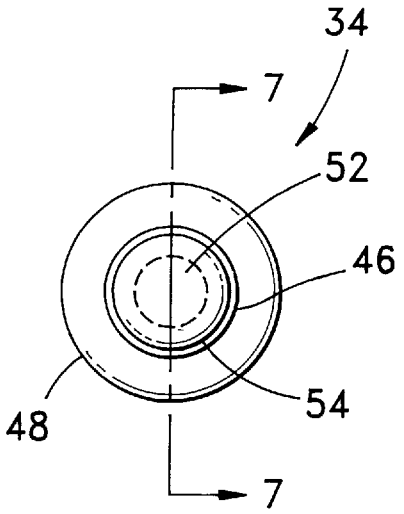
Figure 9:
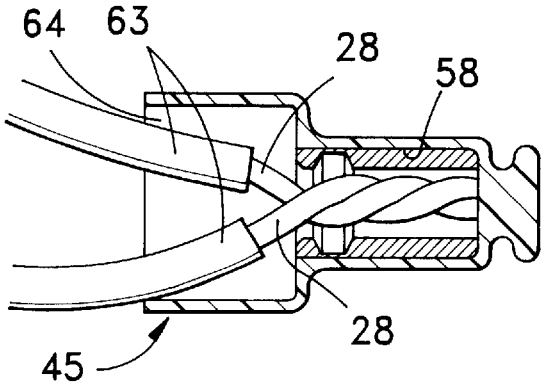
FIG. 9 is a view similar to that of FIG. 7 showing a pair of twisted leads in place for crimping.
Figure 7:
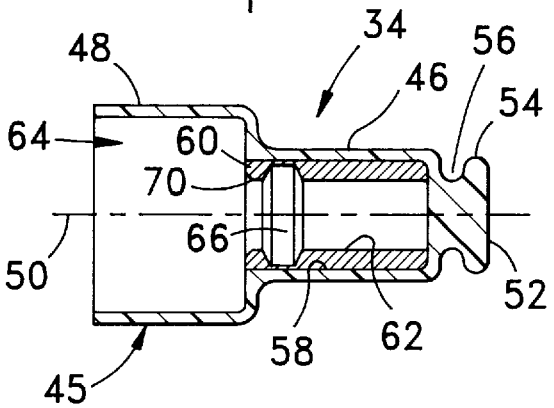
FIG. 7 is a cross-sectional view taken along the lines 7—7 of FIG. 6.
Figure 8:
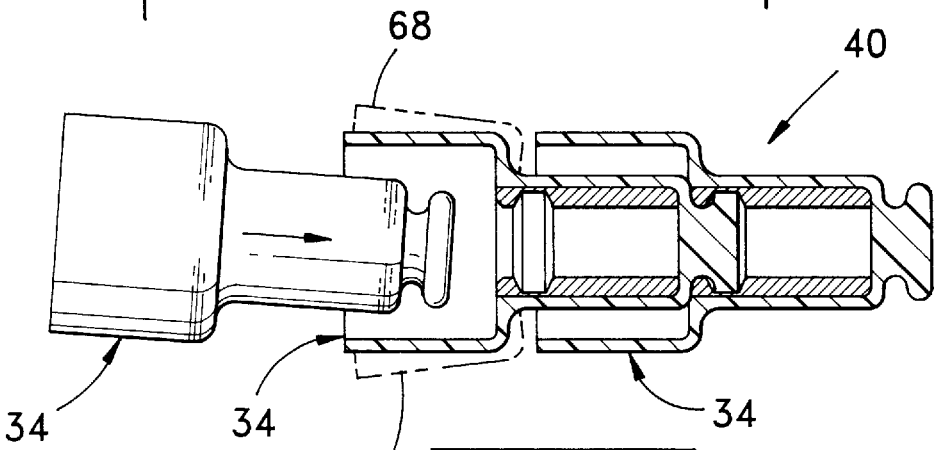
FIG. 8 is a partial cross-sectional view showing the mating of several wire connectors into a chain.

Each of the wire connectors 34, as best seen in FIGS. 5, 6, and 7, includes a cylindrically shaped housing 45 having a shank 46 and a concentric shroud 48 that is of a larger diameter than the shank. The housing 45 is made of an electrically insulating material and has a longitudinal axis 50. The shank 46 terminates in an end 52 having a torus shaped portion 54, which is referred to herein as a first feature, and an undercut 56. The wire connector 34 has an interior cavity 58 within the shank 46 containing a metal ferrule 60. The ferrule 60 has an interior diameter 62 that is sized to receive the twisted ends of the leads 28, in a manner that is well known in the art. The shroud 48 has an interior opening 64 that is large enough to accommodate insulation 63 that may be on the leads 28 so that the bare conductors can extend well into the ferrule, as shown in FIG. 9. As best seen in FIG. 7, an annular groove 66 is formed in the interior diameter 62 of the ferrule 60 adjacent the interior opening 64. The groove 66 is shaped and sized to conform substantially to the shape and size of the torus shaped portion 54 with clearance. The annular groove 66 is referenced herein as a second feature. When the end 52 of one wire connector 34 is pushed into the interior opening 64 and into engagement with the annular groove 66 of another wire connector, the torus shaped portion 54 of the first connector elastically deforms slightly and then enters into mated engagement with the groove of the second connector, as shown in FIG. 8, with a snapping action. The clearance is sufficient so that there can be substantial pivotal movement between the two connectors about the mated torus portion and groove, as indicated by the phantom lines at 68 in FIG. 8. The two connectors are separably attached and their longitudinal axes 50 are considered to be in substantial alignment, although the connectors may pivot somewhat. The two wire connectors can be easily separated by simply exerting an axial force in opposite directions sufficient to pull them apart. When forming the annular groove 66, a lead-in chamfer 70 is formed in the beginning of the interior diameter 62, as best seen in FIG. 7. This lead-in chamfer serves to guide the end 52 when bringing the connectors into separable mated engagement to form a chain 40, as shown in FIG. 8. Additionally, the chamfer 70 also serves as a lead-in for the ends of the leads 28 during the manufacturing operation at the work station 20. It will be understood that the torus shaped portion 54, while very effective, may take other shapes as well, such as a cylindrical shape with rounded corners, and other shapes without departing from the teaching of the present invention.

When several of the wire connectors 34 are separably attached together, as described above to form a chain 40, there is sufficient pivoting at each attachment point to permit wrapping the chain onto the reel 32 for subsequent use at the work station 20. The chain 40 is flexible enough so that it can be easily dereeled and used in the tool 22, as shown in FIG. 4. Alternatively, the chain 40 can be provided in relatively short lengths instead of on a reel. A short length can then be inserted into the opening 42 of the tool 22 in a manner similar to that of the chain. In operation, the tool 22 is positioned so that the twisted leads 28 are within the opening 64 of the wire connector 34 so that the leads extend fully into the interior diameter 62 of the ferrule 60, as shown in FIG. 9. The tool is then operated so that the crimping dies 44 are closed to crimp the ferrule 60, through the insulating housing 45, onto the twisted leads thereby electrically connecting them together.

Figure 10:
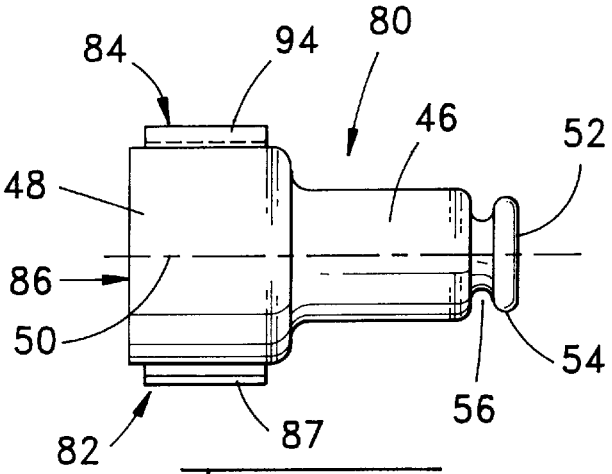
FIGS. 10 and 11 are side and end views of a second embodiment of a wire connector incorporating the teachings of the present invention.
Figure 11:
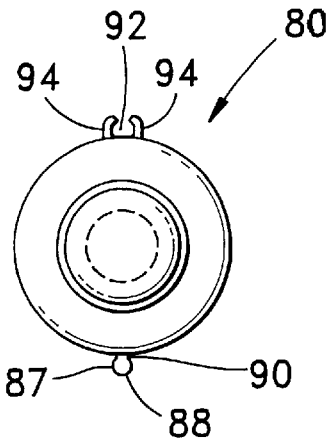
Figure 13:
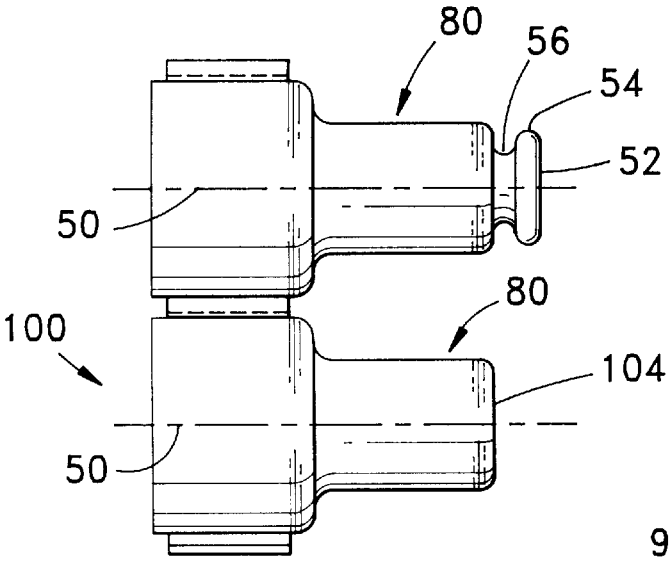
FIGS. 12 and 13 are plan and end views, respectively, showing the mating of several of the wire connectors of FIG. 10 into a chain.
Figure 13:
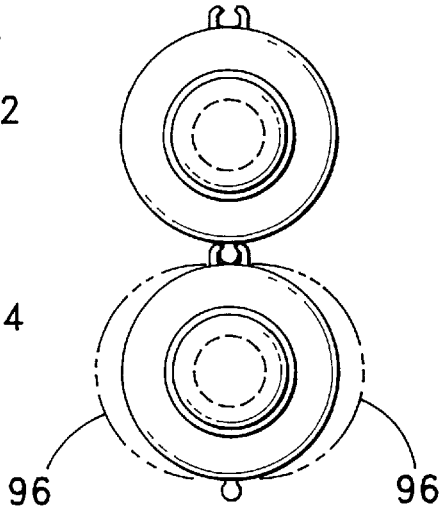
Figure 12:
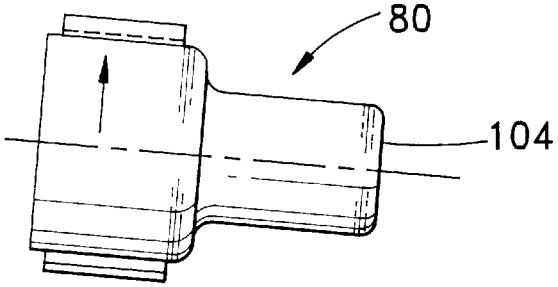

An alternative embodiment of the present invention is shown in FIGS. 10, 11, and 12. There, a wire connector 80 is shown having a housing 86 that, except for third and fourth features 82 and 84, respectively, is identical to the housing 45 of the connector 34, including the interior cavity 58 and the ferrule 60 contained therein. The third feature 82 includes a rib 87 having a rounded edge 88 that extends along the entire length of the rib and substantially parallel to the longitudinal axis 50. The rib 82 has a necked down portion 90 adjacent the housing 86. The fourth feature 84 includes a channel 92 formed by a pair of closely spaced ribs 94 that is shaped and sized to conformably receive the rib 82 with clearance. When the rib 87 of one wire connector 86 is pushed into the channel 92 of another wire connector, the two ribs 94 of the second connector elastically deform slightly permitting the rib 87 to enter into mated engagement with the channel of the second connector, as shown in FIGS. 12 and 13, with a snapping action thereby holding the two parts together. The clearance is sufficient so that there can be substantial pivotal movement between the two connectors about the rib 87 and the channel 92, as indicated by the phantom lines at 96 in FIG. 13. The two connectors are separably attached and their longitudinal axes 50 remain parallel, although the connectors may pivot somewhat laterally. The two wire connectors can be easily separated by simply exerting a lateral force in opposite directions sufficient to pull them apart. As shown in FIG. 12, several of the wire connectors 80 can be mated to form a chain 100 of separably attached wire connectors that can be wound onto a reel 32 for subsequent use at the work station 20 in a manner similar to that of the chain 40. Additionally the chain 100 can be made of a relatively few wire connectors 80 thereby providing a short length that can easily be stored in a tray or flat box. In either case, the string 100 of separable wire connectors 80 can be utilized by the tool 22 having a side loading chute 102, as shown in FIG. 4. The chain 100 of wire connectors 80 is presented to the tool by inserting an end of the chain into the end of the chute 102 and cycling the tool until the first wire connector is advanced into crimping position within the crimping dies 44 in a manner similar to that of the chain 40 of wire connectors. It will be noted, as shown in FIG. 12, that the wire connector 80 may include the end 52 with the torus shaped portion 54 and undercut 56, or it need not have these structures. When these structures are present then the ferrule 60 will have the annular groove 66. When these structures are not present, as shown at 104 in FIG. 12, then the ferrule 60 may but need not have the annular groove 66.

Figure 15:
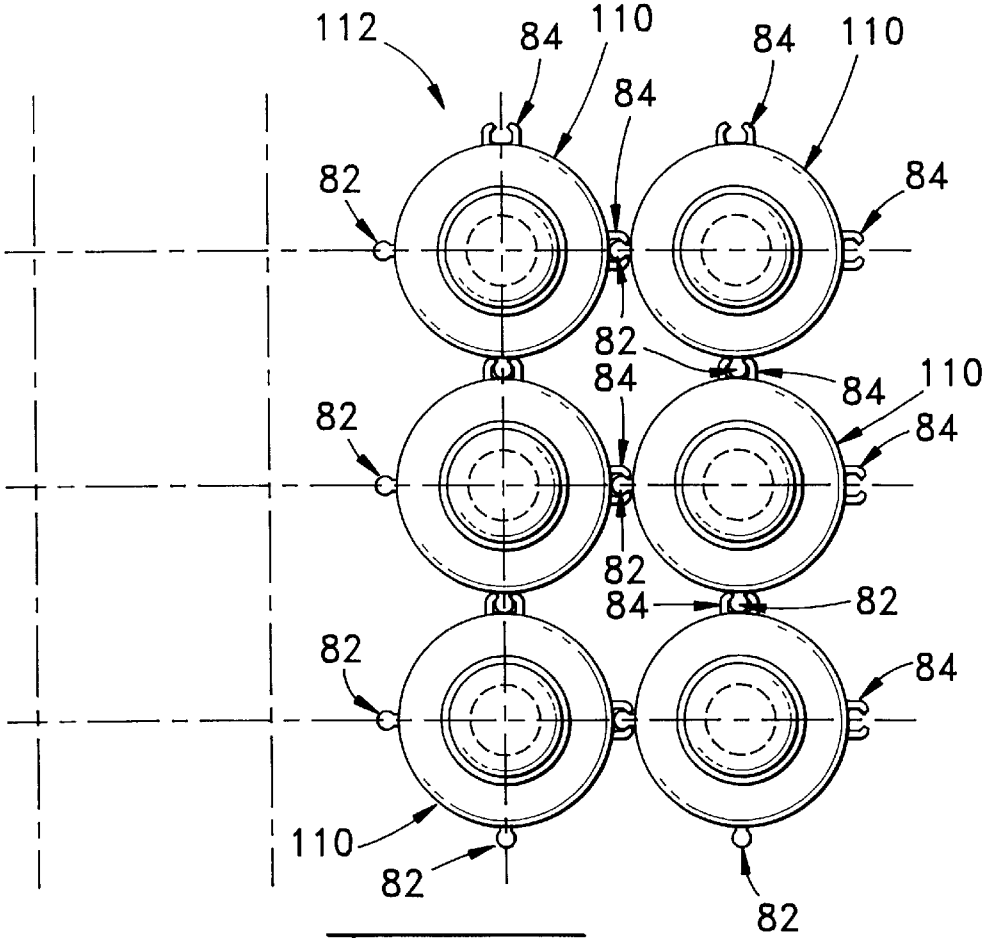
FIGS. 14 and 15 are plan and end views, respectively, of a variation of the wire connectors of FIG. 10 shown in a block arrangement.
Figure 14:
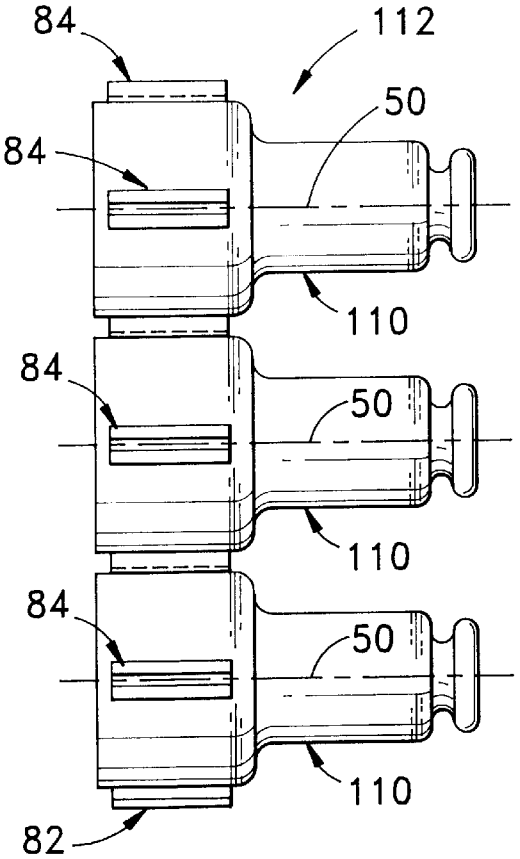

A variation of the wire connector shown in FIG. 10 is shown in FIGS. 14 and 15. There a wire connector 110 is shown that is identical to the wire connector 80 except that it includes a second pair of third and fourth features 82 and 84 that are spaced about 90 degrees to the other pair, as best seen in FIG. 15. This permits the stacking of individual wire connectors into blocks 112 by interlocking the two pairs of third and fourth features. The block 112 can be of any convenient width or length to accommodate the tool or machine that will use the block during the manufacturing operation. In this case, each individual wire connector 110 may be removed from the block 112 by simply pushing it along its axis 50 until the two pair of third and fourth features separate. The term "chain", as used herein, will be understood to include structures such as the chains 40 and 100 as well as the block 112.

While wire connectors 34 and 80 are described and utilized in the explanation of the present invention, it will be understood that parts other than wire connectors may advantageously utilize the teachings of the present invention. Such other parts may, for example, include molded or cast housings for electrical connectors or other devices, electrical contacts or other parts of such other devices, or any other part that is used in quantity by a tool in performing a manufacturing operation. Additionally, while the first, second, third, and fourth features 54, 66, 82, and 84, respectively, are described as having rounded or curved conforming surfaces that separably mate to hold the parts together in a chain structure, other shapes are considered to be within the scope of the present invention. Such other shapes include angled or rectangular surfaces or any combination of such surfaces with or without arcuate surfaces that provide a socket like receptacle and conforming projection that is separably received within the socket. The only requirement is that the shape permit relative easy mating so that the two parts are held together and easy separation by simply pulling the two parts apart without damage to the parts.

An important advantage of the present invention is that the individual parts are easily separated from the chain of parts during the manufacturing operation without damage to the parts. Additionally, the parts are separable without the need for a shearing operation by the tool, and there are no carrier strips or connecting links remaining that need to be discarded, thereby reducing packaging waste. Another important advantage is that each individual part is maintained in a known orientation for proper feed indexing and insertion.

We claim:

1. A wire connector for splicing two conductors together, comprising:

an insulating housing having an opening communicating with an internal cavity, and an electrically conductive ferrule inside said cavity for receiving said two conductors, said ferrule being crimpable through said housing for electrically interconnecting said two conductors; and first and second spaced apart mating features on said wire connector arranged so that said first feature of one said wire connector is adapted for mating engagement with said second feature of another said wire connector, said first mating feature comprising an annular groove in an internal diameter of said ferrule and said second mating feature comprising a torus shaped projection arranged to elastically deform when partially inserted into said annular groove during said mating, and to snap into said mated engagement with said annular groove upon complete insertion thereof, whereby when said one and another wire connectors are so mated they are separably held together and slightly pivotable.

2. The wire connector according to claim 1 wherein said internal cavity and said ferrule have a common longitudinal axis and wherein said first and second features are arranged so that when said one and another wire connectors are in mated engagement, said longitudinal axis of each connector is in approximate alignment with said longitudinal axis of the other connector.

3. A plurality of wire connectors, each wire connector being arranged for splicing two conductors together including an insulating housing having an opening communicating with an internal cavity, an electrically conductive ferrule inside said cavity for receiving said two conductors, said ferrule being crimped through said housing for electrically interconnecting said two conductors, first and second spaced apart mating features on each said plurality of wire connectors arranged so that said first feature of one said wire connector is adapted for mating engagement with said second feature of another said wire connector, wherein said second feature is an annular groove in an internal diameter of said ferrule and said first feature is a torus shaped projection arranged to elastically deform when partially inserted into said annular groove during said mating, and to snap into said mated engagement with said annular groove upon complete insertion thereof, so that when said one and another wire connectors are so mated they are separably held together, and wherein each of said plurality of wire connectors is in said mated engagement with another of said wire connectors thereby forming a chain of said mated wire connectors.

4. The chain of mated wire connectors according to claim 3 wherein each said projection is slightly pivotable within its respective annular groove and wherein said chain is disposed on a reel.

5. A wire connector for splicing two conductors together, comprising:

an insulating housing having an opening communicating with an internal cavity, and an electrically conductive ferrule encircling said longitudinal axis inside said cavity for receiving said two conductors, said housing having a longitudinal axis extending through said ferrule, said ferrule being crimpable through said housing for electrically interconnecting said two conductors; and first and second spaced apart mating features on said wire connector arranged so that said first feature of one said wire connector is adapted for mating engagement with said second feature of another said wire connector, said first mating feature comprising an elongated first rib on an outer surface of said housing extending parallel to said longitudinal axis, said first rib having a rounded edge along its length and a necked down portion adjacent said housing, said second mating feature comprising a channel formed by a pair of closely spaced elongated second ribs on an outer surface of said housing extending parallel to said longitudinal axis and arranged to elastically deform when said first rib is partially inserted into said channel during said mating, and to snap into said mated engagement with said first rib upon complete insertion thereof, whereby when said one and another wire connectors are so mated they are separably held together.

6. The wire connector according to claim 5 wherein said first rib and said channel are arranged so that when said one and another wire connectors are mated, they are slightly pivotable while their respective longitudinal axes remain parallel.

7. The wire connector according to claim 5 wherein said first rib and said channel are diametrically opposed.

8. The wire connector according to claim 5 including two said first ribs and two said channels spaced so that each said first rib is diametrically opposed to a respective channel.

9. The wire connector according to claim 8 wherein said two first ribs are spaced 90 degrees apart.

10. A plurality of wire connectors, each wire connector being arranged for splicing two conductors together including an insulating housing having an opening communicating with an internal cavity, an electrically conductive ferrule inside said cavity for receiving said two conductors, said housing having a longitudinal axis extending through said ferrule, said ferrule being crimpable through said housing for electrically interconnecting said two conductors, first and second spaced apart mating features on each said plurality of wire connectors arranged so that said first feature of one said wire connector is adapted for mating engagement with said second feature of another said wire connector, said first mating feature comprising an elongated first rib on an outer surface of said housing extending parallel to said longitudinal axis, said first rib having a rounded edge along its length and a necked down portion adjacent said housing, said second mating feature comprising a channel formed by a pair of closely spaced elongated second ribs on an outer surface of said housing extending parallel to said longitudinal axis and arranged to elastically deform when said first rib is partially inserted into said channel during said mating, and to snap into said mated engagement with said first rib upon complete insertion thereof, so that when said one and another wire connectors are so mated they are separably held together, and wherein each of said plurality of wire connectors is in said mated engagement with another of said wire connectors thereby forming a chain of said mated wire connectors.

11. The plurality of wire connectors according to claim 10 wherein each said wire connector includes two said first ribs and two said channels, said first ribs and said channels arranged so that each said wire connector can be concurrently mated with at least two other wire connectors, thereby forming a block of wire connectors.

12. The wire connector according to claim 11 wherein said two first ribs of each wire connector are spaced 90 degrees apart and each said first rib is diametrically opposed to a respective channel.

* * * * *